United States Patent [19]

Johnson

[11] 3,987,605

[45] Oct. 26, 1976

[54] ROTARY ARTICLE TRANSFER APPARATUS

[75] Inventor: Reginald Frank Johnson, Gainsborough, England

[73] Assignee: Baker Perkins Holdings Limited, Peterborough, England

[22] Filed: June 11, 1975

[21] Appl. No.: 585,887

[30] Foreign Application Priority Data

June 12, 1974 United Kingdom ..... 25991/74

[52] U.S. Cl. ..... 53/234; 53/370

[51] Int. Cl.[2] ..... B65B 11/34

[58] Field of Search ..... 53/225, 227, 234, 370; 198/210

[56] References Cited

UNITED STATES PATENTS

| | | | |
|---|---|---|---|
| 3,124,065 | 3/1964 | Bozek | 198/210 X |
| 3,175,673 | 3/1965 | Hagner et al. | 198/210 X |
| 3,175,702 | 3/1965 | Banyas | 198/210 X |
| 3,789,576 | 2/1974 | Giles | 53/234 |
| 3,885,374 | 5/1975 | Schmermund | 53/234 |
| 3,899,865 | 8/1975 | Revaz | 53/225 X |

*Primary Examiner*—Travis S. McGehee
*Assistant Examiner*—John Sipos
*Attorney, Agent, or Firm*—Fitzpatrick, Cella, Harper & Scinto

[57] ABSTRACT

A rotary article-transfer apparatus, specifically intended for use in a sweet-wrapping apparatus, comprises a rotatable main support, a pocket support slidably mounted on the main support provided with an article receiving pocket, a cam follower mounted on the pocket support and arranged in engagement with a cam track arranged about the axis of rotation of the main support so that, upon rotation of the main support, an article fed to the pocket at one circumferential position, e.g., a feeding position, at a given radial distance from the axis of rotation is moved to another circumferential position, e.g., a twisting position, at a different radial distance from that axis.

6 Claims, 4 Drawing Figures

Figure 1:
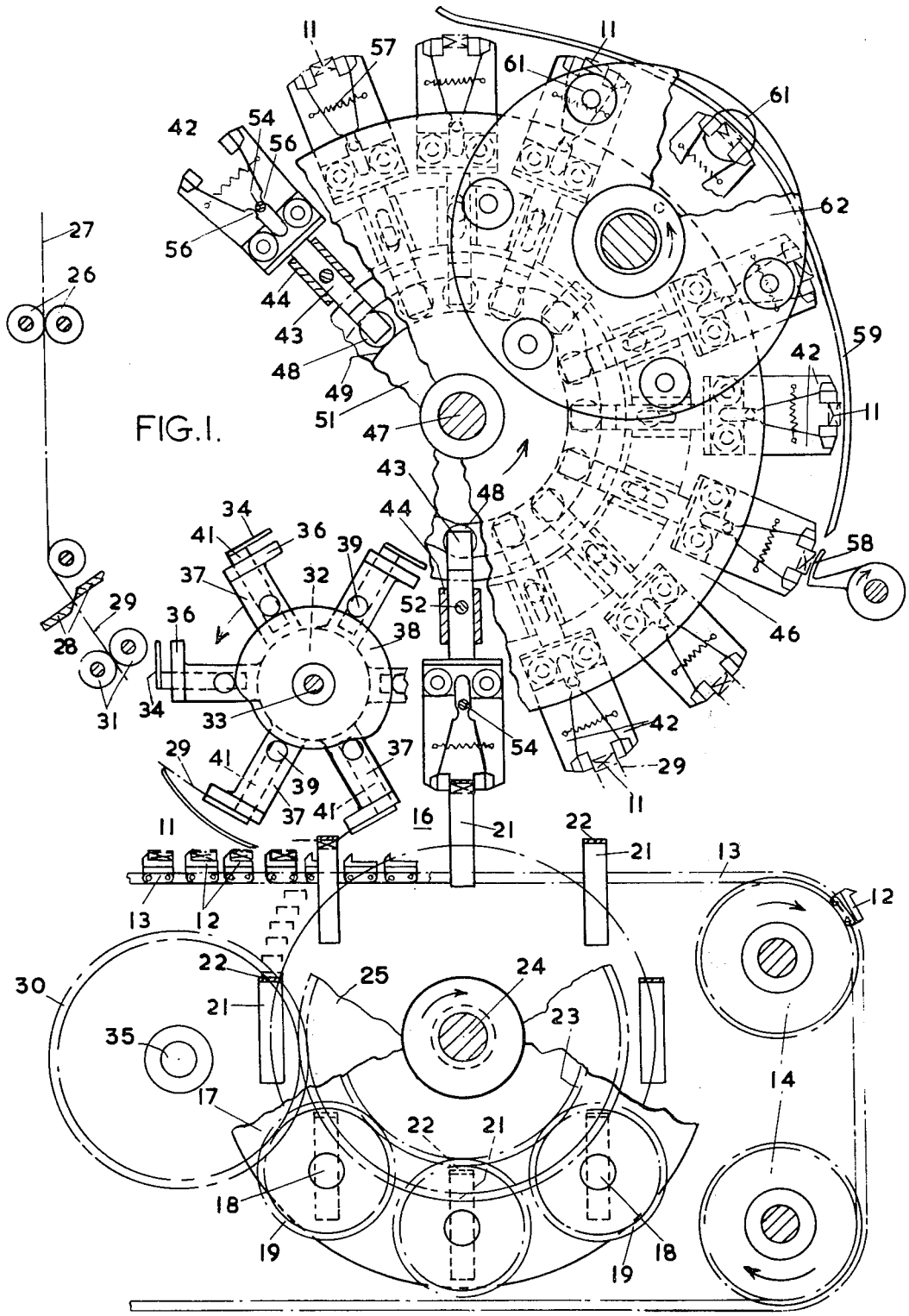

11
57
61
11
61
42
54
56
62
27
56
26
44
43
59
48
42
49
11
51
47

43
48
34
44
41
36
39
58
37
32
52
29
36
38
46
28
34
33
31
54
42
29
41
37
29
39
37
41
11
16
21
22
21
13
11
13
12
12
22
25
24
30
21
23
35
14
17
22
21
18
19
18
19

ROTARY ARTICLE TRANSFER APPARATUS

This invention relates to wrapping apparatus of the kind (hereinafter referred to as the "kind described") in which articles e.g., sweets, are fed in succession, each with a wrapper of paper, film, foil or other wrapping material, into successive pockets of a wrapping member movable over an arcuate path, e.g., a wrapping wheel, the wrappers being partially folded about the respective articles during the feeding action and caused completely to envelope the articles by one or a series of wrapper-closing operations performed subsequent to the feeding action, the final wrapper closing operation being performed on a part of the wrapper extending from at least one end of the article in a direction parallel to the axis of curvature of the path of movement of the pockets of the wrapping member.

Such apparatus has, in the past, contained mechanism operating with intermittent motion with obvious disadvantages such as exessive wear, and noise both of which have necessitated relatively low limits of operation and consequently high production costs. Efforts have, therefore, been made to replace many of the prior intermittent mechanisms by continuously movable apparatus capable of operating at much higher speeds because of the smoother action of such motion and the minimising of the above disadvantages.

Such efforts have had some success and there are at present wrapping machines operating in which the articles pass continuously from a feed conveyor to the wrapping member and through the series of wrapping operations to the discharge station. The resulting increase in operating speeds has, however, resulted in the wrapping members being driven at speeds greater than the optimum speeds for efficient operation. To overcome this new disadvantage, it is now proposed to increase the radius of curvature of the wrapping member to provide a corresponding increase in the number of pockets carried by that member and consequently to allow a reduction in the rate of operation of the wrapping member while maintaining the improved rate of production arising from the continuous motion referred to above.

With such continuous motion, however, the final wrapper-closing operation has necessarily been performed by a closing unit movably synchronously with each pocket of the wrapping member over a portion of the arcuate path of the wrapping member sufficient for the closing operation to be performed. One way of accomplishing this, when using a wrapping member in the form of a wrapping wheel, would to be provide a continuously rotatable closing member, co-axial with the wrapping wheel, having a number of closing units equal to the number of pockets in the wrapping wheel and disposed in alignment therewith. Such a closing member would, however, be unnecessarily large and expensive considering that each closing unit is only operative over a small portion of its arcuate path of movement.

An object of the invention is to alleviate the various difficulties referred to above while at the same time providing a continuous wrapping apparatus capable of efficient operation at the improved rate of production envisaged above.

According to the present invention, therefore, there is provided a wrapping apparatus of the kind described comprising a wrapping member that is continuously movable over its arcuate path, a plurality of pocket supports each slidably mounted individually on the wrapping member, a cam follower mounted on each pocket support, a cam track arranged about the axis of curvature of said arcuate path and arranged for engagement by said cam followers thereby to control the sliding movement of said pocket supports, an article-receiving pocket mounted on each pocket support, a continuously rotatable closing member mounted for movement about an axis radially spaced from the axis of the arcuate path of said wrapping member and provided with a plurality of closing units disposed at equal circumferential distances around a pitch circle concentric with the axis of rotation of said closing member and cutting the arcuate path of movement of said wrapping member, the number of said closing units being substantially less than the number of pockets of the wrapping member, means for driving the wrapping member and the closing member at such relative speeds that, as each pocket of the wrapping member approaches a final wrapper-closing station, a closing unit moves towards a position of alignment with that pocket, said cam track being so shaped as to cause the pocket for the time being approaching said closing station to move into alignment with that closing unit and remain in such alignment during operation of said closing unit.

Figure 4:
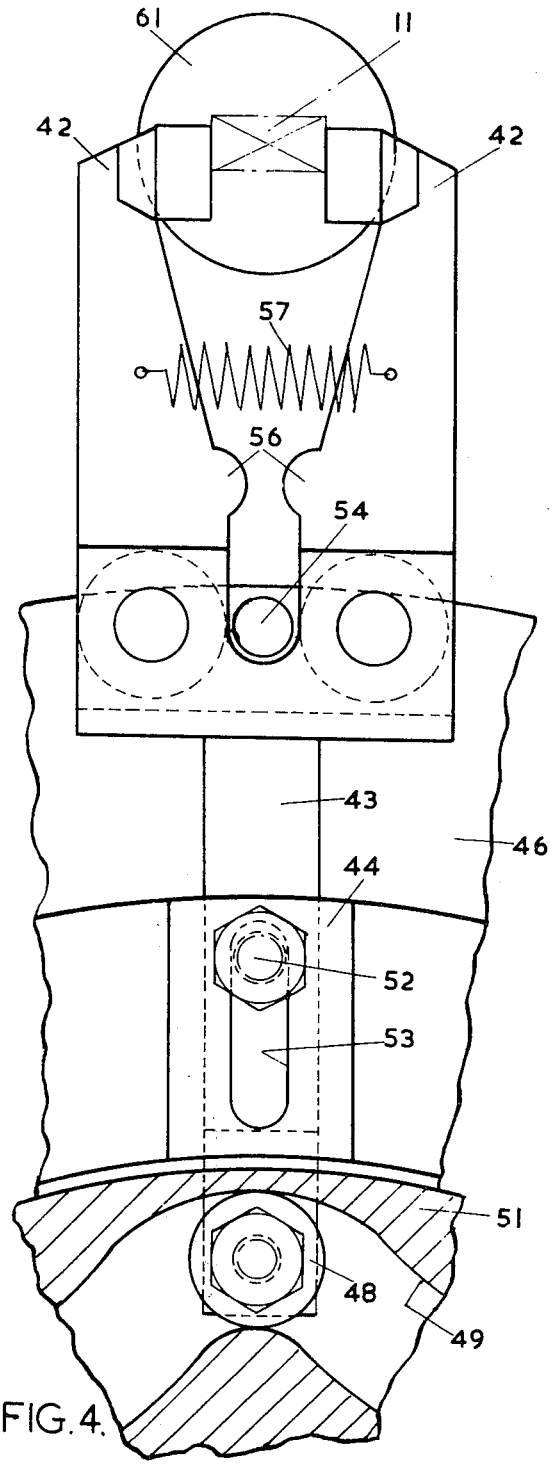
Figure 2:
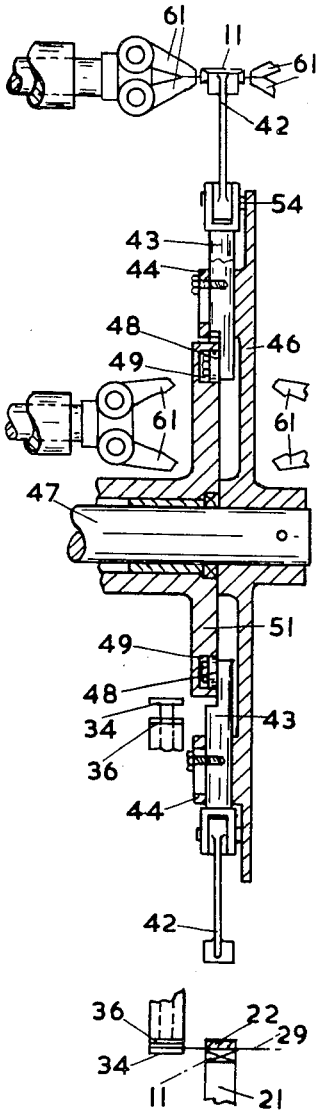
Figure 3:
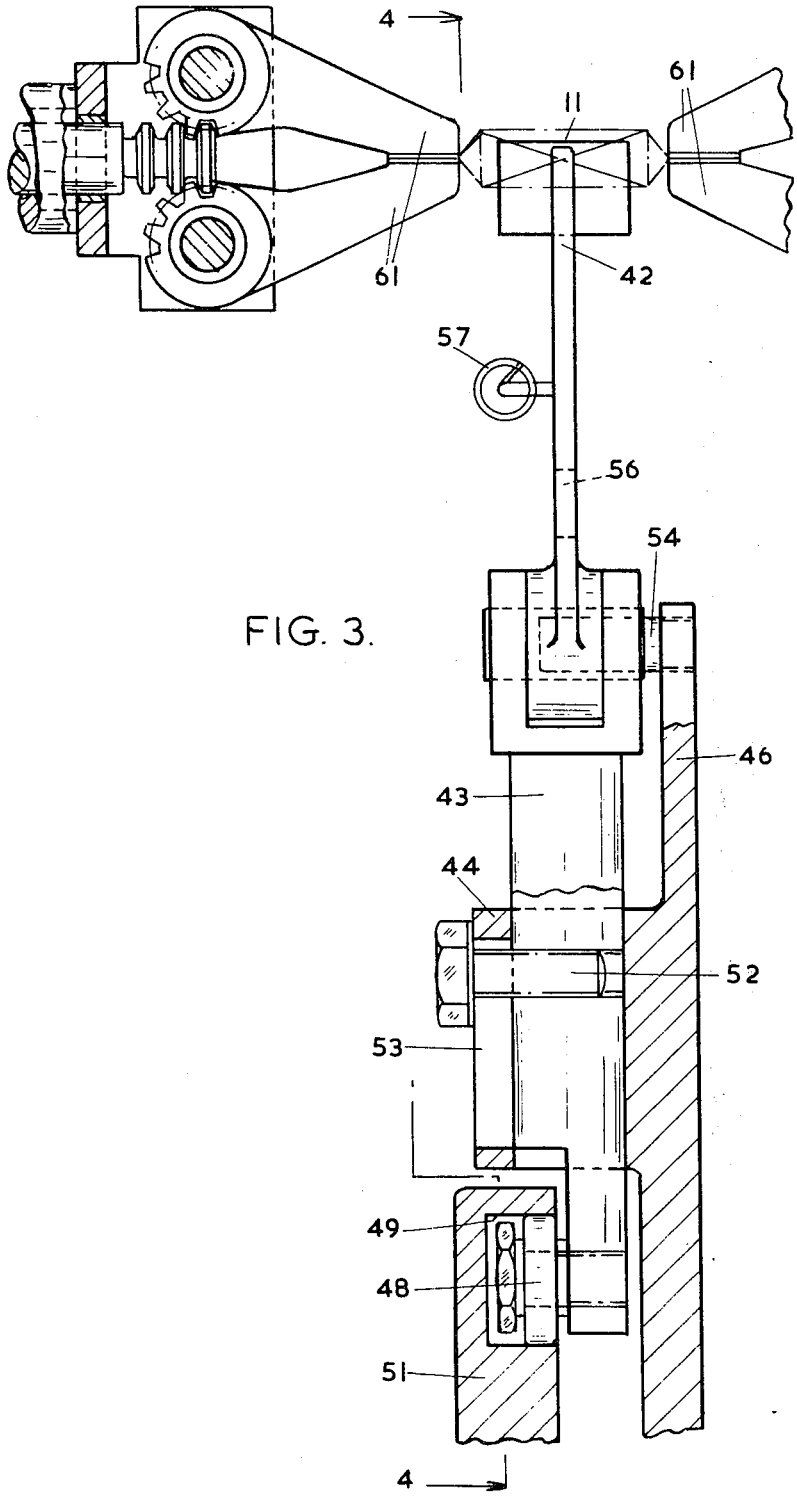

The pockets of the wrapping member conveniently each consist of a pair of spring-loaded gripping jaws pivotally mounted on the respective pocket support and means are provided on the wrapping member for opening the jaws and allowing them to close during the sliding movement of the pocket supports as required for receiving the articles at a feeding station and releasing them for delivery at a subsequent station, respectively. Such construction may constitute the wrapping wheel of the sweet wrapping machine described below, by way of example, with reference to the accompanying diagrammatic drawings in which:

FIG. 1 shows, in elevation, the essential components of a continuously operable sweet wrapping machine, FIG. 2 is a sectional end view of part of the machine shown in FIG. 1, FIG. 3 is an end view, partly in section, of a detail of the machine and drawn to a somewhat larger scale, and FIG. 4 is a view taken on the line 4—4 in FIG. 3.

Referring particularly to FIG. 1 sweets 11 contained in pockets 12 of a continuously operating infeed conveyor 13 mounted on sprockets 14 (two only shown) are transported to a feeding station 16 of a wrapping machine. At the station 16 the sweets 11 are transferred, in succession, from the pockets 12 into successive pairs of gripping jaws on a continuously rotating wrapping wheel by a continuously operable elevator mechanism, a wrapper of film, foil, or other wrapping material being fed into the path of movement of each sweet so as to be carried with the sweet into the gripping jaws in the manner described below.

The elevator mechanism consists of a rotatable disc 17 on which are mounted on plurality of spindles 18 at equal circumferential intervals each spindle 18 having secured to it at one end a driven gear 19 and at the other end a bracket (not shown) on which is mounted a pusher 21 and a wrapper nipping member 22. The driven gears 19 are arranged in mesh with a common driving gear 23 freely mounted on a shaft 24 which drives the rotatable disc 17. The gear 23 is driven by a gear 25 meshing with a gear 30 secured to a driving shaft 35. The speed of the shaft 35 and the ratio of the gearing is so chosen that the spindles 18 are caused to rotate in the opposite direction to the direction of rotation of the disc 17 at such a rate that the pushers 21, which are initially arranged vertically and parallel to each other, move, during rotation of the disc 17, upwardly and downwardly in parallel relationship. Such an arrangement of pushers is described in U.S. Pat. No. 3,135,373.

Arranged above the conveyor 13 is a wrapper feeding device consisting of a pair of continuously rotating feed rollers 26 which feed a web 27 of wrapping material towards a severing device 28 of well known construction which cuts successive wrappers 29 from the web 27. As a wrapper 29 is about to be severed from the web 27 the leading edge of the wrapper 29 passes into the nip of a further pair of continuously rotating rollers 31 which feed the wrapper 29 towards a continuously moving transfer gripper wheel 32 secured to a driving shaft 33 and carrying a series of pairs of gripper jaws 34, 36, the outer surfaces of the jaws 36 constituting the gripping surfaces of the gripper wheel 32. The rollers 31 are driven at a higher rate than that of the feed rollers 26 to increase the rate of travel of the wrapper 29 to substantially the peripheral speed of the gripping surfaces of the gripper wheel 32. Each jaw 34 is slidably mounted in a bearing 37 formed on the wheel 32 and actuated by a stationary cam 38, arranged about the shaft 33, which engages a spring-loaded roller 39 secured to a shank 41 of each jaw 34. The timing of the cam 38 is such that the gripper 34 is allowed to move, under the action of its spring, to trap the leading edge of a wrapper 29 against the jaw 36 as the trailing edge of the wrapper leaves the rollers 31.

The pairs of jaws 34, 36 transfer the wrappers 29, in succession, on to the upper faces of successive sweets as they are removed from the pockets 12 by the pushers 21 at which moment the jaws release the successive wrappers which are then successively trapped on to the upper surfaces of the successive sweets by the successive wrapper nipping members 22 as described in British patent application No. 870/73.

At the feeding station 16 successive pushers 21 transfer successive sweets 11, together with their wrappers, into successive pockets each constituted by a pair of gripping jaws 42 pivotally mounted on one end of a pocket support 43 slidably mounted in bearings 44 formed at equal circumferential distances on a continuously rotating wrapping wheel 46 secured to a shaft 47. A cam roller 48 is rotatably mounted on the other end of the support 43 and arranged to run in a stationary cam track 49 formed in a disc 51 arranged about the axis of rotation of the shaft 47. To prevent rotational movement of the support 43 in the bearing 44, a stud 52 is secured in the support 43 and arranged to pass through a slot 53 (FIG. 4) formed in the bearing 44.

The opening and closing of the jaws 42 at the feeding station 16 and subsequently at an ejection position is effected by the sliding movement of the support 43. Thus, as successive pairs of jaws 42 approach the feeding station 16 they are first moved radially inward by the cam 49 which action causes one of a series of pegs 54 secured in the wheel 46 to engage lobes 56 on the jaws 42 which opens the latter against the action of a spring 57 secured to the jaws 42. After a sweet with its wrapper has been fed into the jaws they are moved radially outwards by the cam 49 sufficient to move the lobes 56 clear of the peg 54 to allow the jaws to close on to the sweet under the action of the spring 57. At the subsequent ejection position the jaws are once again moved radially inwards by the cam 49 to open the jaws as mentioned above.

As each sweet 11 is transferred into the jaws 42 the wrapper 29 is folded about one face and two opposed sides of the sweet in the form of an inverted "U" with portions of the wrapper extending from the sides and end faces of the sweet. Continued rotation of the wheel 46 carries the partially wrapped sweet to a first folding position where the portion of the wrapper extending from the trailing side of the sweet is folded onto the lower face of the sweet by a continuously rotating folder 58, the portion of the wrapper extending from the leading side of the sweet then being folded onto the already folded portion of the wrapper by a stationary folder blade 59 during further movement of the wheel 46.

With each sweet 11 thus enclosed in an open-ended tube of wrapping material the wheel 46 carries successive sweets to a wrapper twisting station where a series of continuously operating pairs of twisting grippers 61 are rotatably mounted on rotating drums 62, one on either side of the wheel 46, and operate in known manner to twist the portions of the tube extending from each end of the sweet 11 to form a fantail which completes the wrapping operation.

The arrangement of the slidable jaws 42 of the wrapping wheel 46 allows the common axis of the twister drums 62 to be displaced radially from the axis of the wrapping wheel which is found vary convenient in the design of the wrapping machine. It also enables the use of twister drums 62 with a number of pairs of twisting grippers 61 less than the number of jaws 42 on the wrapping wheel 46, in this example 6 to 16, the pitch circles of the twisting gripper axes and the axes of the tubes enclosing the sweets being driven at the same peripheral speed during the twisting action.

The twisting action is performed while the axis of the tube enclosing the sweet 11 in any pair of gripper jaws 42 is travelling over an arc corresponding substantially with the pitch circle of the twisting gripper axes. Thus, in operation, as each pair of jaws 42 approaches the wrapper twisting station it is moved radially outwards by the cam track 49 to a position such that the path of movement of the sweet in the jaws 42 coincides with the pitch circle of the twisting grippers 61 operating on that sweet such path of movement being maintained by the action of the cam track 49 over the arc of operation of the twisting grippers 61. Upon completion of the wrapper twisting operation the jaws 42 are moved radially inwards by the action of the cam track 49 to open the jaws 42 so as to allow the wrapper sweet to be ejected at a collecting station.

We claim:

1. Apparatus of the kind described comprising a wrapping member, means moving said wrapping member continuously along an arcuate path, a plurality of pocket supports each slidably mounted individually on the wrapping member, a cam follower mounted on each pocket support, a cam track arranged about the axis of curvature of said arcuate path and arranged for engagement by said cam followers thereby to control the sliding movement of said pocket supports, an article-receiving pocket mounted on each pocket support, a continuously rotatable closing member mounted for movement about an axis radially spaced from the axis of the arcuate path of said wrapping member and provided with a plurality of closing units disposed at equal circumferential distances around a pitch circle concentric with the axis of rotation of said closing member and cutting the arcuate path of movement of said wrapping member, the number of said closing units being substantially less than the number of pockets of the wrapping member, means for driving the wrapping member and the closing member at such relative speeds that, as each pocket of the wrapping member approaches a final wrapper-closing station, a closing unit moves towards a position of alignment with that pocket, said cam track being so shaped as to cause the pocket for the time being approaching said closing station to move into alignment with that closing unit and remain in such alignment during operation of said closing unit.

2. Apparatus as in claim 1, wherein the wrapping member is constituted by a wheel on which the pocket supports are disposed radially.

3. Apparatus as in claim 2, wherein the pockets each consist of a pair of spring-loaded gripping jaws pivotally mounted on the respective pocket supports and means are provided on the wrapping member for opening the jaws and allowing them to close during the sliding movement of the pocket supports as required for receiving the articles at a feeding station and releasing them for delivery at a subsequent station, respectively.

4. Apparatus as in claim 1, comprising a pair of closing members arranged co-axially one on each side of the wrapping member.

5. Apparatus as in claim 4, wherein the closing units are constituted by twisting units.

6. Apparatus as in claim 4, wherein the closing units are constituted by crimping units.

* * * * *